United States Patent [19]

Hadtke

[11] 4,027,880

[45] June 7, 1977

[54] TENNIS TUNER

[75] Inventor: Frederick B. Hadtke, New Providence, N.J.

[73] Assignee: Idex Corporation, Scotch Plains, N.J.

[22] Filed: Jan. 9, 1976

[21] Appl. No.: 647,909

[52] U.S. Cl. ..... 273/29 A; 273/58 C

[51] Int. Cl.[2] ..... A63B 69/38

[58] Field of Search ..... 273/25, 26 R, 26 E, 273/29 R, 29 A, 32 R, 35 R, 185 C, 185 D, 200 R, 200 B, 58 C, 61 R, 95 R, 95 A; 35/29 R, 29 A

[56] References Cited

UNITED STATES PATENTS

| | | | |
|---|---|---|---|
| 708,573 | 9/1902 | Miles | 273/29 A X |
| 831,605 | 9/1906 | Doyle | 273/26 E |
| 861,506 | 7/1907 | Doyle | 273/26 E |
| 1,708,796 | 4/1929 | Lawrence | 273/29 A |
| 3,042,401 | 7/1962 | Denegre | 273/26 E |
| 3,310,306 | 3/1967 | Burt | 273/26 E |

FOREIGN PATENTS OR APPLICATIONS

| | | | |
|---|---|---|---|
| 16,765 | 5/1935 | Australia | 273/200 R |
| 1,045,446 | 6/1953 | France | 273/95 A |

*Primary Examiner*—William H. Grieb
*Attorney, Agent, or Firm*—Alexander T. Kardos

[57] ABSTRACT

A captive ball device or apparatus for practice purposes in sports, particularly the various forms of tennis, comprising: a captive ball; relatively inelastic, high strength, high hardness, medium or average cut-growth rate cords attached to the captive ball; and relatively elastic, lower strength, low hardness, high cut-growth rate cords, the ends of which are attached to the ends of the relatively inelastic, high strength cords, the other ends of the relatively elastic, lower strength cords being adapted to be secured to poles or other vertical supports at a predetermined, yet variable, height above the ground or floor and at a predetermined, yet variable, distance from the captive ball. Alternatively, the relatively inelastic, high strength cords and the relatively elastic, lower strength cords may be replaced by extremely high elastic, very high strength, average or medium hardness, low cut-growth rate cords which extend from one pole or vertical support to the captive ball and then from the captive ball to the other pole or other vertical support.

9 Claims, 8 Drawing Figures

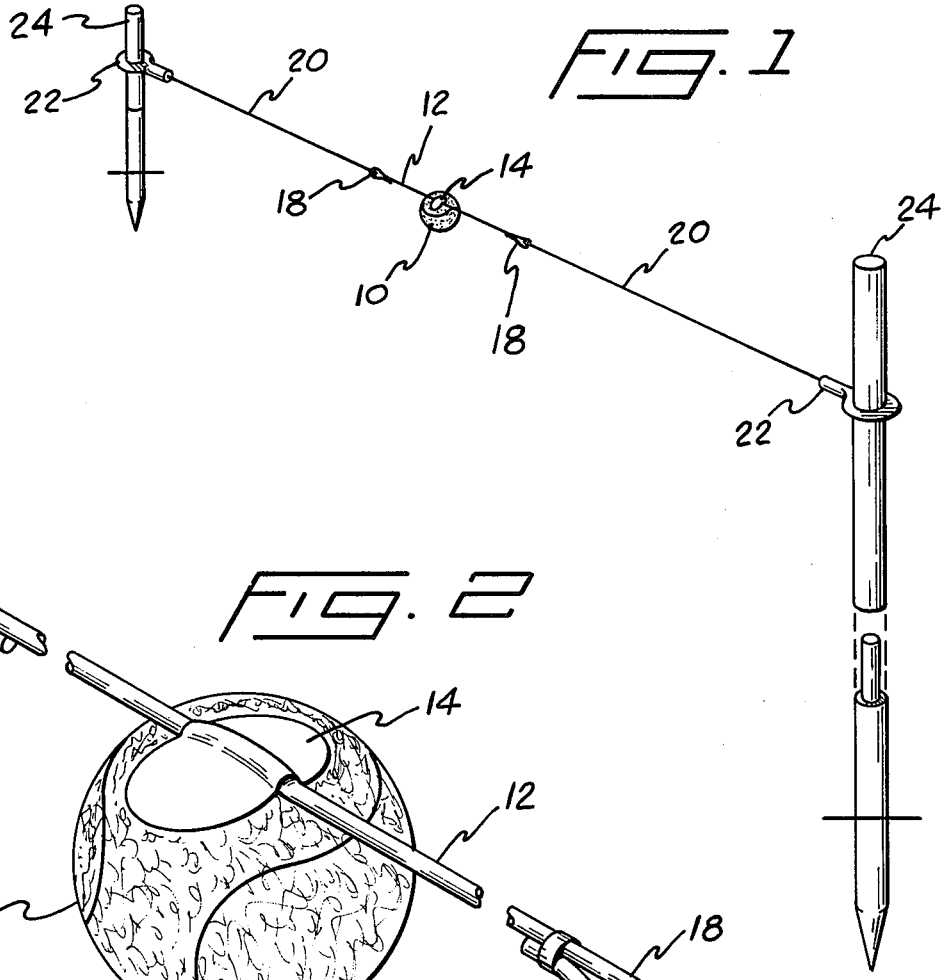
FIG. 1
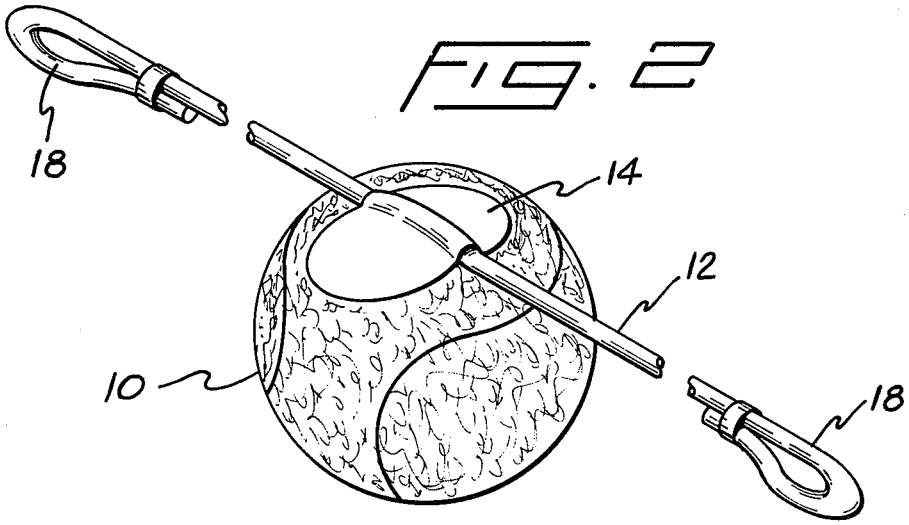
FIG. 2
FIG. 3
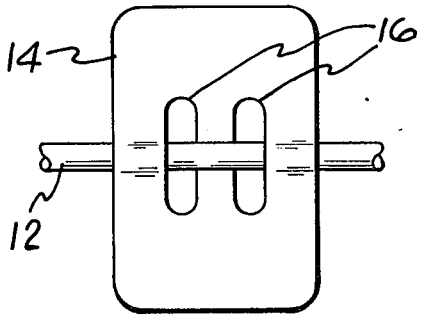
FIG. 6
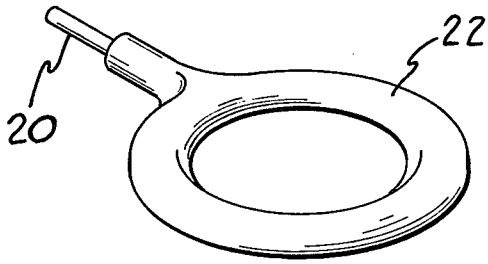

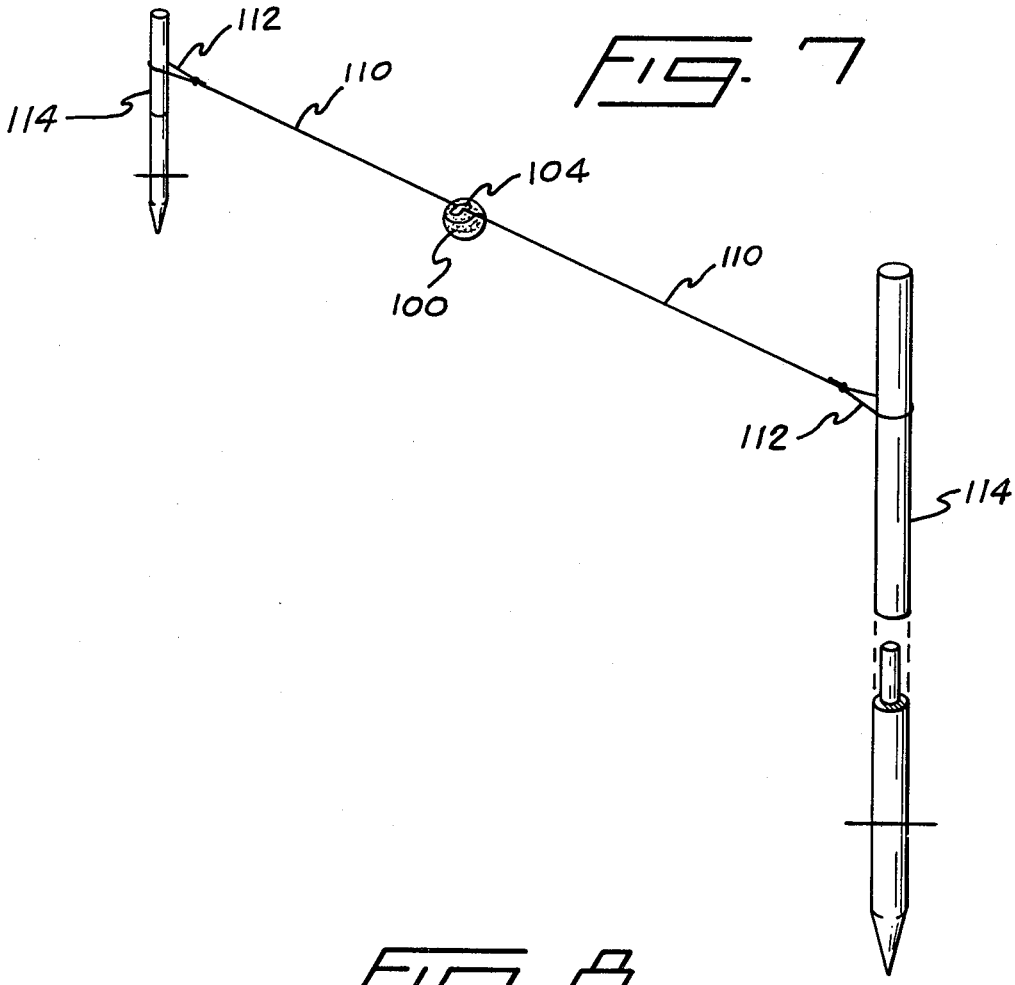
FIG. 7
FIG. 8
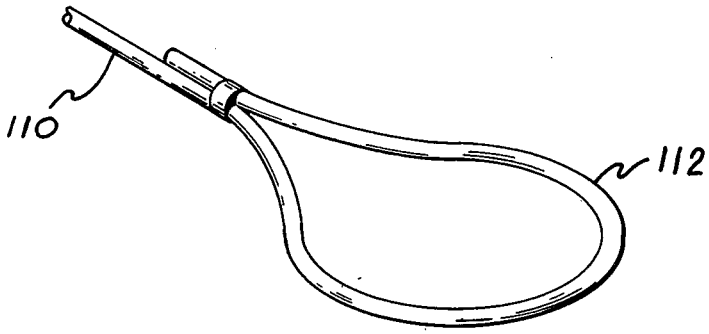

TENNIS TUNER

THE FIELD OF THE PRESENT INVENTION

The present invention relates to captive ball devices and apparatus for practice purposes in sports, such as, for example, the various forms of tennis, and, more particularly, relates to captive ball devices and apparatus used for developing abilities and skills involving stroking or striking a ball properly while it is in very rapid mid-air flight, such strokes being described in tennis as forehand drives, backhand strokes, volleys, etc.

GENERAL BACKGROUND OF THE PRESENT INVENTION

Many devices and apparatus have previously been developed in efforts to simulate the very rapid mid-air flight of a ball in various sports and to enable a devotee of the sport to practice the proper and correct stroking or striking of that ball in mid-air. Tennis is an excellent example of such a sport and the present invention will be illustrated and described in connection with tennis but it is to be understood that such is primarily for the purposes of illustration and the inventive concept, in its broader aspects, is not to be construed as limited to such a sport.

Some of these prior devices and apparatus have been developed and have been commercialized to some degree but they have not really accurately or precisely simulated the true, very rapid flight of a tennis ball in mid-air. As a consequence, such prior devices and apparatus have not been really commercially acceptable or successful.

Additionally, in many cases, the ball, after being stroked or struck, either did not come back to the striker at all, or did not return in about the same manner or to the same location. As a result, the need for repetitive practice of the same, identical swing was not satisfied and the swing could not be "grooved".

Also, an area element was involved. Tennis has enjoyed a very rapid expansion and growth in the past few years and the number of available tennis courts and practice courts is insufficient to meet the ever-growing demand. Such tennis courts are rather large in area, a tennis court measuring 36 feet by 78 feet, and with the required additional room at each side of the side lines and in back of the base lines, brings the total required area to well over 5,000 square feet. Such large areas are, unfortunately, not too available, especially in or near cities.

However, if a smaller area could be used for practice purposes, there would naturally be a greater availability of such smaller areas and thus more practice devices and apparatus could be constructed and used. In this way, the pressure of the demand for the use of the large, conventional tennis courts would be lessened. However, the more satisfactory prior practice devices and apparatus required nearly as large an area as the conventional tennis courts and thus did not increase the availability of utilizable areas and did not lessen the demand for the use of the large area conventional tennis courts.

The need is therefore still very great for some sort of practice device or apparatus which can be utilized in a relatively smaller area and which can accurately and precisely simulate the very rapid flight of a tennis ball in mid-air and which can practically guarantee the return of the ball to the hitter in about the same manner and to the same location to facilitate the requirement of repetitiveness in order to "groove" the swing.

PURPOSES AND OBJECTS OF THE PRESENT INVENTION

It is therefore a principal purpose and object of the present invention to provide a captive ball device or apparatus which is capable of accurately and precisely simulating the very rapid mid-air flight of a ball, and especially a tennis ball, which can be used in a relatively small space, as compared to the very large area required for a full size conventional tennis court, or for prior practice devices and apparatus; and which is capable of returning the tennis ball to the hitter in about the same manner and to the same location each and every time the tennis ball is stroked in order to facilitate the "grooving" of the swing. Other principal purposes and objects of the present invention will become clear from a further reading and understanding of this specification.

BRIEF SUMMARY OF THE PRESENT INVENTION

It has been found that such principal purposes and objects can be achieved by providing a captive ball device or apparatus for practice purposes in sports, particularly tennis, comprising: a captive ball; relatively inelastic, high strength, high hardness, medium or average cut-growth rate cords attached to the captive ball; and relatively elastic, lower strength, low hardness, high cut-growth rate cords, the ends of which are attached to the ends of the relatively inelastic, high strength cords, the other ends of the relatively elastic, lower strength cords being adapted to be secured to poles or other vertical supports at a predetermined, yet variable, height above the ground or floor and at a predetermined, yet variable, distance from the captive ball, said predetermined heights and distances being variable and adjustable to suit the available areas as well as the heights of the persons using the practice device or apparatus. Alternatively, the relatively inelastic, high strength cords and the relatively elastic, lower strenth cords may be replaced by extremely highly elastic, very high strength, medium or average hardness, low cut-growth rate cords which extend from one ole or vertical support to the captive ball and then from the captive ball to the other pole or other vertical support, said extremely highly elastic, very high strength cords being adapted to be secured to the poles or vertical supports at predetermined, yet variable, heights above the ground or floor to suit the height of the person using the practice device or apparatus, with the poles or other vertical supports being spaced apart a predetermined, yet variable distance depending upon the extent of the available space.

BRIEF DESCRIPTION OF THE DRAWINGS

In the following specification and accompanying self-explanatory drawings, there are described and illustrated preferred embodiments of the present inventive concept but is is to be understood that the invention, in its broader aspects, is not be construed as limited to such preferred embodiments, except as defined and as limited by the scope of the appended claims.

Referring to the accompanying self-explanatory drawings,

FIG. 1 is a simplified schematic perspective drawing, showing a preferred embodiment of the practice device and apparatus of the present inventive concept;

FIG.2 is a detail perspective drawing, showing in greater detail typical means for securing the relatively inelastic, high strength cords to the captive tennis ball;

FIG. 3 is a detail plan view of a typical form of the fabric-reinforced, adhesively-faced mounting patch employed to secure the relatively inelastic, high strength cords to the captive tennis ball;

FIG. 6 is a simplified schematic perspective drawing, showing a typical mounting ring used in the practice device and apparatus of FIG. 1;

FIG. 7 is a simplified schematic perspective drawing, showing still another variation of the principles of the present inventive concept; and FIG. 8 is a simplified schematic perspective drawing, showing another typical mounting ring which can be used in the various modifications of the principles of the present inventive concept.

DESCRIPTION OF THE PREFERRED EMBODIMENT OF THE PRESENT INVENTION

Figure 4:
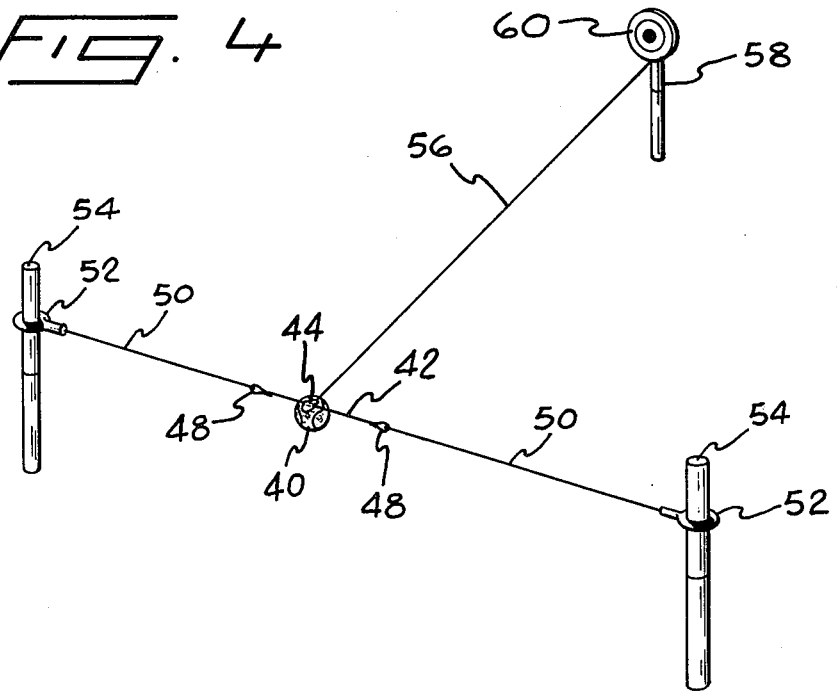
FIG. 4 is a simplified schematic perspective drawing, showing a variation of the practice device and apparatus of FIG. 1.

Referring to FIG. 1 of the drawings, there is shown a captive tennis ball 10 to which a relatively inelastic, high strength cord 12 is secured adhesively or otherwise by means of a relatively non-tearable, fabric reinforced, adhesively faced mounting patch 14. As shown, the relatively inelastic, high strength cord 12 is secured to the captive tennis ball 10 substantially at its center or mid-point and the mounting patch 14 holds the relatively inelastic, high strength cord 12 in a non-slipping grip so as to prevent slipping of the captive tennis ball 10 from the mid-point of the relatively inelastic, high strength cord 12.

If desired, two shorter, separate, relatively inelastic, high strength cords approximately of equal length may be used and may be secured to the captive tennis ball 10 by a similar mounting patch, instead of the single relatively inelastic, high strength cord 12.

THE MOUNTING PATCH

The relatively non-tearable, fabric-reinforced, adhesively-faced mounting patch 14 comprises a plastic or textile material, such as "Mylar" polyethylene terephthalate resin fim material, or "Tyvek" spun bonded non-woven material, or "Masslinn" or "Keybak" non-woven fabric, or neoprene rubber-coated nylon fabric, or other pliant or conformable material which be smoothly secured without wrinkles to the spherical curvature of the captive tennis ball 10. The adhesive which is used to secure the mounting patch 14 to the captive tennis ball 10 may be any suitable conventional adhesive which is available commercially.

If desired, as shown in FIG. 3, two holes or slits 16 may be formed in the mounting patch 14 and the relatively inelastic, high strength cord 12 may be threaded through these holes or slits 16 in order to enhance the gripping and non-slipping action of the mounting patch 14 on the relatively inelastic, high strength cord 12.

The ends of the relatively inelastic, high strength cords 12 are formed into loops 18, 18 in order to facilitate the attaching thereto of lengths of relatively elastic, lower strength cords 20, 20. The cords 12 and 20 may be attached together by simply knotting the two, or by using a third thread or band to tie the two cords together, or they may be joined by adhesive means. In any event, the attachment of the two cords 12 and 20 should be strong and of a permanent nature.

The other ends of the relatively elastic, lower strength cords 20, 20 are also formed into loops, which may more properly be termed mounting rings 22, 22 which are elastic and conformable in nature and which are adapted to be fitted over vertical poles 24, 24, or other supports to hold the practice device or apparatus in the configuration shown in FIG. 1. Another variation of the mounting ring is to be noted in FIG. 8, to be described in more detail hereinafter. The mounting rings 22, 22 are adapted to be slid up or down along the length of the poles 24, 24 to provide for an easy and simple adjustability of the practice device or apparatus so that the height of the captive tennis ball 10 and its suspending cords can be adjusted to suit the height of the person using the practice device or apparatus.

The mounting rings 22, 22 are elastic in nature and, after the desired lengths of the suspending cords have been established for a particular situation, they are normally stretched to fit over the poles 24, 24 and are thus held in position by friction and by tension, or, if necessary, by hooks or by fitting into positioning notches, or by other means which will prevent them from possibly slipping downwardly during use of the practice device or apparatus.

As illustrated in FIG. 1, the poles 24, 24 are shown as having a telescoping construction, with pointed ends at their lower extremities, and are adapted to be thrust into the ground to hold the poles vertically in position. However, such is merely illustrative and the relatively elastic, lower strength cords 20, 20 may be secured to other holding devices, structures walls, and the like, as desired.

Also, the relatively elastic, lower strength cords 20, 20 can be secured to holding deviceswhich are spaced apart various distances whereby the speed and the timing of the return of the captive tennis ball 10 to the hitter can be varied. Additionally, the tension in the suspending cords 12 and 20 can be varied as to change the rapidly and the timing of the return or rebound of the captive tennis ball 10.

THE SUSPENDING CORDS

As used herein, the terms "relatively inelastic, high strength cords" and "relatively elastic, lower strength cords" and other terms used herein, are used in the same general sense as that set forth in A.S.T.M. Standards Designations D123–72, D1566–72, and D1418–72 on "Definitions" and "Nomenclature"; D2433–72 on "Testing Rubber Threads"; D2731–72 on "Elastic Properties of Elastomeric Yarns"; and 1052–65 on "Resistance . . . . to Cut Growth . . . . ", with the following modifications.

The term "cord" used herein to include strands, yarns, strings, monofilaments, multifilaments, and other cord-like materials having the required strength, elastic, and other characteristics and properties described herein.

The term "strength" is used herein reference to tensile strength and denotes the strength of the cord when subjected to tension, as distinct from compression, torsion, or shear.

The relatively inelastic, high strength cord 12 is, in some cases, considered to be an "elastomer" which, by A.S.T.M. definition, includes natural and synethetic polymers, such as natural or synthetic rubber, spandex, and other elastomeric materials, which, at room temperature, can be stretched repeatedly to at least twice its original length and which, after removal of the tensile load or other stretching force, will immediately and forcibly return to its original length.

As used herein, however, the term "relatively inelastic, high strength cord" is defined and limited to include cords, strands, and the like, which cannot be stretched repeatedly to three and a half times its original length without breaking or rupturing or suffering permenent deformation or permanent set. Under normal circumstances at room temperature, the relatively inelastic, high strength cord can be stretched repeatedly only to from about 110% to less than 350% of its original length without breaking or rupturing and without suffering permanent deformation or permanent set, and, after removal of the tensile load or other stretching force, will immediately and forcibly return to approximately its original length, with a small temporary deformation of a few percent, due to the lack of 100% immediate elastic recovery.

These relatively inelastic, high strength cords 12 have tensile strengths in the range of from about 3,100 to about 4,000 pounds per square inch which, as used herein, represents the maximum tensile stress expressed in force per unit area of the cord at the time of rupture or breaking. These relatively inelastic, high strength cords 12 also have high hardness properties in the range of from about 53 to about 65 (durometer hardness test) and a medium or average cut-growth rate.

Specific examples of relatively inelastic, high strength cords include: natural or synthetic polymers, natural and synthetic rubber, black neoprene, and other strands, filaments, etc., having relatively high strength characteristics so that they fall in the above-mentioned strength range of from about 3,100 to about 4,000 pounds per square inch and upon their stretch characteristics so that they cannot be stretched repeatedly to about 350% of their original length without breaking or rupturing and without suffering permanent deformation or permanent set. The elastomeric materials mentioned herein are of applicability within the principles of the present invention, provided they are so formulated and compounded as to bring their strengths within the indicated range and to reduce their stretch characteristics so that they cannot be stretched to about 350% of their original lengths without breaking or rupturing or without suffering permanent deformation or pemanent set.

The relatively elastic, lower strength cord 20 is considered in all cases to be an "elastomer"(as defined above by the A.S.T.M.) with the following limitation. The relatively elastic, lower strength cord 20 must be capable of being stretched repeatedly to at least 400% of its original length and which, after removal of the tensile load or other stretching force, will immediately and forcibly return to approximately its original length, with a small temporary deformation of a few percent, due to the lack of 100% immediate elastic recovery. Under normal circumstances at room temperatures, the relatively elastic, lower strength cord 20 can be stretched repeatedly at least to about 400% and up to about 750% of its original length without breaking or rupturing or without suffering permanent deformation or permanent set and, after removal of the tensile load or other stretching force, will immediately and forcibly return to approximately its original length.

These relatively elastic, lower strength cords 20 have tensile strengths in the range of from about 2,000 to about 2,900 pounds per square inch, have relatively low hardness properties in the range of from about 24 to about 33, and have a relatively high cut-growth rate.

Specific examples of relatively elastic, lower strength cords 20 include: natural and synthetic polymers, natural and synthetic rubber, gum rubber, latex cord, latex rubber, and other strands, filaments, etc., in carbon-free or relatively low carbon content so that they are capable of being stretched at least to about 400% of their original length; "Spandex" materials comprising long chain synthetic polymers comprised of at least 85% of a segmented polyurethane, such as DuPont "Lycra", Union Carbide "Unel", Ameliotex "Numa", Globe "Glospan", etc. "Anidex" materials which are long chain synthetic polymers composed of at least 50% by weight of one or more esters of a monohydric alcohol and an acrylic acid, such as Rohm & Haas "Anim/8" is also of use within the principles of the present invention. These materials can be so prepared that they will possess the strength characteristics which fall within the above-mentioned range of from about 2,000 to about 2,900 pounds per square inch and can be stretched at least to about 400% of their original length and in some cases up to about 750%, without breaking or rupturing or without suffering permanent deformation or permanent set.

With regard to the terms "carbon-free" or relatively low carbon content" and "relatively high carbon content" which are used herein in referring to the relatively elastic, lower strength cords and the relatively inelastic, high strength cords, respectively, such refers to the percentages of carbon which is included as carbon black, channel black compound, or the like, in the formulating and compounding of rubber. The inclusion of such carbon normally makes the rubber stronger and less liable to tear or rupture or wear out from the effects of abrasion, although at a loss of elasticity and stretch characteristics.

As used herein, "low carbon content" rubber is intended to cover such materials having zero or less than about 0.5% by weight of carbon, as based on the total weight of the formulated rubber material. Also, as used herein, the term "relatively high carbon content" rubber is intended to cover such compounded rubber materials having at least about 8% by weight of carbon, based on the total weight of the compounded and formulated rubber material.

It must be remembered, however, that the overriding and important factor still remains the strength properties and characteristics and the elasticity and stretch properties and characteristics of the rubber suspending cords within the ranges set forth herein.

The total length of the relatively inelastic, high strength cord 12 secured to the captive tennis ball 10 is in the range of from about 2 feet to about 4 feet and preferably is in the range of from 2½ feet to about 3½ feet. If two separate relatively inelastic, high strength cords 12 are used, one on each side of the captive tennis ball 10, then these lengths are, of course, divided in half.

The lengths of the relatively elastic, lower strength cords 20 depend upon many factors, primarily the available space, and the elastic action and rebound or return time which is desired. Under normal circumstances, each relatively elastic, lower strength cord 20 has a length of from about 6 feet to about 15 feet and preferably from about 7 feet to about 13 feet.

Such a combination of strength and stretch properties and characteristics and length relationships provides an unusual and unexpected result in that, whenever the captive tennis ball 10 is stroked properly, it rapidly flies away from the person using the practice device or apparatus and then returns in an excellently simulated, very rapid mid-air flight of a tennis ball, and then surprisingly always with the captive tennis ball leading the way ahead of the suspending cords and the mounting patch, so that the captive tennis ball is always struck again at the next opportunity rather than striking the suspending relatively inelastic, high strength cord 12 or the mounting patch 14, which would not be desirable.

Additionally, and also surprisingly, a properly stroked captive tennis ball 10 will return more or less directly to the hitter on an automatic and repetitive basis so that he is immediately made aware if the timing of his stroke was good and if his swing was correct and proper. However, if the return of the captive tennis ball 10 is erratic and does not come back more or less directly to the hitter but rather at a little distance away, so that the hitter has to "reach" for it, or move more than he should, then the hitter knows that the timing of his stroke was bad and that he did not strike the captive tennis ball 10 properly. In either event, however, the captive tennis ball 10 is always returned sufficiently close to the hitter so that he is able to continue hitting the captive tennis ball 10 and there is no need for him to temporarily interrupt and discontinue his practice and chase after any tennis ball which was not hit well, and would have otherwise sailed off and come to a rest at a considerable distance from him.

THE MODIFICATION OF FIG. 4

In FIG. 4, there is illustrated a modified version of the preferred embodiment of the practice device and apparatus of FIG. 1, and wherein corresponding parts in FIG. 4 are identified by reference numerals which are 30 greater than the reference numerals used in FIG. 1.

In FIG. 4, there is shown a captive tennis ball 40, relatively inelastic, high strength suspending cords 42, a relatively nontearable, fabric-reinforced, adhesively-faced mounting patch 44, attaching loops 48, 48, relatively elastic, lower strength, suspending cords 50, 50, elastic and conformable mounting rings 52, 52, and vertical pole supports 54, 54, of a similar construction, nature, and use as those of FIG. 1.

Additionally, a third relatively elastic, lower strength cord 56 is secured to the mounting patch 44 and is then stretched slightly and secured to a third vertical pole support 58, having a bulls-eye or other target 60 thereon. The third relatively elastic, lower strength cord 56 extends generally perpendicularly to the straight line established by the suspending cords 42 and 50 and has a length in the range of from about 20 feet to about 30 feet or more. In mounting the third relatively elastic, lower strength cord 56, care should be taken not to stretch it too much inasmuch as undue tension therein will tend to pull the captive tennis ball 40 in a rearward direction too much. A small amount of tension, however, is satisfactory.

Such a practice device or apparatus provides an aiming point for practicing tennis player and he is in a better position to visually know if he is doing well or not. Additionally, the third relatively elastic, lower strength cord 56 serves to dampen out and lessen the undesirable effects of mis-hits and thus return the ball even more directly to the hitter on more occasions. This is, of course, of greater value to a novice or beginner to the sport.

THE MODIFICATION OF FIG. 5

Figure 5:
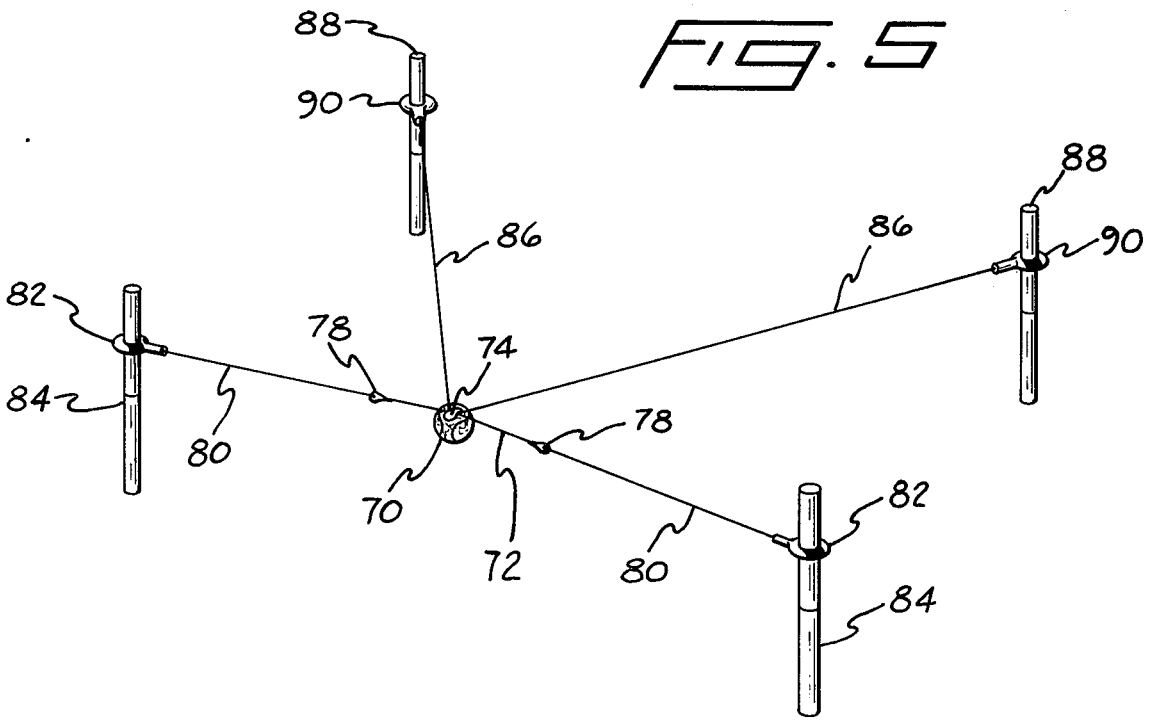
FIG. 5 is a simplified schematic perspective drawing, showing an additional variation of the practice device and apparatus of FIG. 1.

In FIG. 5, there is illustrated another modified version of the preferred embodiment of the practice device and apparatus of FIG. 1, and wherein corresponding parts in FIG. 5 are identified by reference numerals which are 60 greater than the reference numerals used in FIG. 1.

In FIG. 5, there is shown a captive tennis ball 70, relatively inelastic, high strength suspending cords 72, a relatively nontearable, fabric-reinforced, adhesively-faced mounting oatch 74, attaching loops 78, 78, relatively elastic, lower strength, suspending cords 80, 80, elastic and conformable mounting rings 82, 82, and vertical pole supports 84, 84, of a similar construction nature, and use as those of FIG. 1.

Additionally, third and fourth relatively elastic, lower strength cords 86, 86 are secured to the mounting patch 74 and are then stretched slightly and secured to third and fourth vertical pole supports 88, 88. In this arrangement, the four vertical pole supports 84, 84, 88, 88 stand at approximately the four corners of a rectangle, or, if the available room is such, at approximately the four corners of a square or room. The main suspending cords 72 and 80 may suspend the captive tennis ball 70 directly in line between the vertical pole supports 84, 84 or, as shown, the cords may be so arranged in length and strength, as well as elasticity and tension, that the captive tennis ball 70 is suspended slightly inwardly of the rectangle or square formed by the four vertical pole supports.

The lengths of the third and fourth relatively elastic, lower strength cords 86, 86 normally equal each other as well as the length of one section of relatively inelastic, high strength, suspending cord 72 plus one section of relatively elastic, lower strength, suspending cord 80. Such a configuration of cords even further dampens out and reduces the effect of erratic mis-hits and serves to return the captive tennis ball 70 even more directly to the hitter on more occasions.

The modifications illustrated in FIGS. 4 and 5 are set up in generally the same manner. The captive tennis ball is initially suspended on the relatively inelastic, high strength cord and the relatively elastic, lower strength cords which are drawn relatively taut and which extend in a tensioned state in a straight line between the two vertical pole supports. This is basically the position illustrated in FIG. 1. The additional relatively elastic, lower strength cords are then stretched rearwardly under relatively low tension and are secured to their corresponding vertical pole supports. Such relatively low tension is necessary, rather than a relatively high degree of tension, so that the captive tennis ball either remains substantially directly in line between the front vertical pole supports or is slightly to the rear of the straight line passing through the front vertical pole supports. If such relatively low tension were to be increased too much, then the captive tennis ball would be positioned too far in back of the straight line extending between the two front vertical pole supports and the two relatively inelastic, high strength cords would extend angularly and forwardly from the captive tennis ball and could conceivably interfere with the initial striking of the captive tennis ball at the beginning of the practice tennis session.

THE MODIFICATION OF FIG. 7

In FIG. 7, there is illustrated still another variation of the preferred embodiment of the practive device and apparatus of FIG. 1, and wherein corresponding parts in FIG. 7 are identified by reference numerals which are 90 greater than the reference numerals used in FIG. 1.

In FIG. 7, there is shown a captive tennis ball 100, a relatively non-tearable, fabric-reinforced, adhesively-faced mounting patch 104, extremely highly elastic, very high strength, medium or average hardness, low cut-growth rate cords 110, the end of which are formed into elastic or conformable mounting loops or rings 112 which are secured around vertical pole supports 114, 114, of a similar construction, nature, and use as those in FIG. 1.

The extremely highly elastic, very high strength, medium or average hardness, low cut-growth cords 110 are considered in all cases to be true elastomers (as defined previously herein) but have very unusual and specific properties and characteristics. These cords 110 must be capable of being stretched repeatedly to at least about 800% of their original lengths and which, after removal of the tensile load or other stretching force, will immediately and forcibly return to approximately their original lengths. Additionally, these cords 110 must have very high tensile strengths in the range of from about 4,200 pounds per square inch to about 14,000 pounds per square inch. Also, these cords 110 have medium or average durometer hardness values of from about 37 to about 46 and they have extremely low cut-growth rates.

Specific examples of extremely highly elastic, very high strength, medium or average hardness, low cut-growth cords 110 include natural and synthetic polymers, natural and synthetic rubber, gum rubber, latex cord, latex rubber, and other strands, filaments, and yarns, provided they are so formulated and compounded that they possess the strength, elasticity, and other characteristics and properties required of them, as described previously herein.

The outer ends of the extremely highly elastic, very high strength cords 110 are formed into elastic and conformable loops or mounting rings 112 having a similar purpose and use as the mounting rings 22 of FIG. 1. It is again to be appreciated that the extremely highly elastic, very high strength cords 110 may extend from one vertical pole support 114, go through the mounting patch 104 and reach to the other vertical pole support 114 as one single cord. Or, if so desired, one extremely elastic, very high strength cord may extend from one vertical pole support 114 to the mounting patch 104 and then another extremely highly elastic, very high strength cord 110 may extend from the vertical pole support back to the mounting patch 104 on the other side, as two separate cords.

It is also to be appreciated that the extremely highly elastic, very high strength cord 110 may be used to replace the cords 42, 50 and 56 of FIG. 4, as well as the cords 72, 80 and 86 of FIG. 5.

The invention will be further illustrated and described in greater detail by the following specific Examples. It should be understood, however, that, although these Examples may describe in greater particularity some of the more specific features and aspects of the present invention, they are given primarily for purposes of illustration and the inventive concept is not to be construed as limited to the specific features and details set forth therein but to include other materials and configurations.

EXAMPLE 1

The practice device or apparatus of FIG. 1 is used for this Example. The captive ball is a conventional tennis ball. The mounting patch is a relatively non-tearable, nylon fabric-reinforced, adhesively faced neoprene rubber material, measuring about 1 inch by 1½ inches in size. One relatively inelastic high strength suspending cord is used and has a total length of about three feet (1½ feet on each side of the mounting patch on the captive tennis ball). The relatively inelastic, high strength cord is a relatively high-carbon content neoprene rubber material having a maximum stretch or elasticity to less than about 350% of its original length before breaking or rupturing or suffering permanent deformation or permanent set and a tensile strength of about 3,500 pounds per square inch. It has a durometer hardness of 60 and a medium or average cut-growth rate. It is a black neoprene cord and has a circular cross-section of about 3/32nds of an inch in diameter.

The relatively elastic, lower strength cords are each about 8 feet in length and are substantially pure gum zero carbon content natural rubber material having a minimum stretch or elasticity to about 600% of its original length without breaking or rupturing or without suffering permanent deformation or permanent set and a tensile strength of about 2,800 pounds per square inch. It has a durometer hardness of 30 and a relatively high cut-growth rate.

Both the relatively inelastic, high strength cord and the relatively elastic, lower strength cord are capable of immediately and forcibly returning to approximately their original lengths, after being stretched due to the force exerted on the captive tennis ball when struck by the hitter under the conditions of use during practice.

The relatively elastic, lower strength cord has a relatively light color, due to the absence of carbon, and also has a circular cross-section with a diameter of about 3/32nds of an inch.

Vertical pole supports are used to provide the support for the elastic mounting rings on the relative elastic, lower strength cords. These poles are made of aluminum metal, are circular in cross-section with an outside diamter of about three-fourths of an inch.

The poles are made in two sections, each section being about 30 inches in length and are easily plugged or joined together to provide a total length of about 5 feet. Approximately 1 foot of the lower section which has a pointed end is driven into the ground, leaving about 4 feet protruding for the mounting rings. The total overall width of the practice device or apparatus is about 19 feet, and the depth required is about 10 feet.

The practice device or apparatus is used as shown and requires only a fraction of the more than 5,000 square feet required for a conventional size tennis court. In this particular case, only about 190 square feet is required since the overall size is about 10 feet by nineteen feet. The practice device or apparatus does not require any special ground or floor surface, or special preparation thereof, is easily adjustable and can be used equally by short persons or tall persons of any age, and very accurately and precisely simulates the very rapid flight of a tennis ball in mid-air. Both forehand and backhand drives and strokes as well as volleys, rallies, etc., can be used readily. It is very realistic in timing, hitting speed, sound, swing, feel, and tempo, and a full natural swing and follow-through can be used.

EXAMPLE 2

The procedures described in Example 1 are followed substantially as set forth therein with the exception that the arrangement of FIG. 4 is followed. The relatively inelastic, high strength cord and the relatively elastic, lower strength cords remains as shown. However, a rearwardly extending, relatively elastic, lower strength cord is used in addition and is about 19 feet in length. It has a stretch of to about 600%, a tensile strength of about 2,800 pounds per square inch, a relatively low durometer hardness test value of 30, and a relatively high cut-growth rate.

The results obtained in this Example are generally comparable to the results obtained in Example 1, with the exception that an additional dampening action is noted in the return of the ball to the hitter which makes the device or apparatus more suitable for novices and poorer or weaker players. It is believed that this dampening action takes place in the following manner. If the ball is mis-hit in such a way that it would tend to return more or less to the right side of the hitter, then the rearwardly extending, relatively elastic, lower strength cord is stretched to the right and the tension created therein tends to urge the ball to the left, to some degree. In the same way, a mis-hit which would tend to return the ball to the left of the hitter would stretch the rearwardly extending cord to the left and thus create a tension which would tend to urge the ball to the right.

The practice device or apparatus is well suited for use in practice tennis sessions for persons of all ages and all heights.

EXAMPLE 3

The procedures described in Example 1 are followed substantially as set forth therein with the exception that the arrangement of FIG. 5 is followed. The relatively inelastic, high strength cord and the relatively elastic, lower strength cords remain as shown. However, two additional relatively elastic, lower strength cords are used in a rearwardly extending fashion, each being about 12 feet in length and possessing angles of 37° to the line of the main suspending inelastic and elastic cords.

The results obtained in this Example are generally comparable to the results obtained in Examples 1 and 2, with the exception that the dampening action appears to be even more accentuated. The captive tennis ball, even which mis-hit badly, is urged to return to the hitter with the error even further reduced in extent. It is believed that this is due to the fact that the rearwardly extending cords exert a more direct influencing action of the return path of the captive tennis ball. This serves to make the practice device or apparatus even more suited for the novice or beginner and the poorer or weaker player.

The practice device or apparatus is well suited for use in practice tennis sessions for persons of all ages and all heights.

EXAMPLE 4

The procedures set forth in Examples 1, 2, and 3 are followed substantially as described therein with the following exceptions. The relatively inelastic, high strength suspending cords and the relatively elastic, lower strength suspending cords are replaced by a single, 19 foot length of extremely highly elastic, very high strength suspending cord which is capable of being stretched repeatedly to at least about 800% of its original length and which, after removal of the tensile load or other stretching force, will immediately and forcibly return to approximately its original length. Its tensile strength is 4,500 pounds per square inch; it has a durometer hardness test value of 40 which is in the medium to average range; and it has an extremely low cut-growth rate.

The rearwardly extending, relatively elastic, lower strength, dampening cords are also so replaced by the extremely highly elastic, very high strength cords.

The results obtained in the three parts of this Example are also generally comparable to the results obtained in Example 1. The practice device or apparatus is well suited for use in practice tennis sessions for persons of all ages and all heights.

Although several specific Examples of the inventive concept have been described, the invention in its broader aspects should not be construed as limited thereby, nor to the specific features and materials mentioned therein, but to include various other equivalent features and aspects as set forth in the claims appended hereto. It is to be understood that any suitable changes, modifications or variations may be made without departing from the spirit and the scope of the inventive concept.

What is claimed is:

1. A captive tennis ball apparatus for practice purposes comprising: a captive tennis ball; suspending means attached to and suspending said captive tennis ball, comprising at least one relatively inelastic, high strength cord, capable of being stretched repeatedly only to from about 110% to less than about 350% of its original length without breaking or rupturing and without suffering permanent deformation or permanent set; and relatively elastic, lower strength cords, capable of being stretched repeatedly at least to from about 400% to about 750% of their original lengths without breaking or rupturing or without suffering permenent deformation or permanent set, the ends of said relatively elastic, lower strength cords being attached to the ends of said suspending means comprising at least one relatively inelastic, high strength cord, the other ends of said relatively elastic, lower strength cords being adapted to be secured to supports at a predetermined height above the ground or floor and at a predetermined distance from said captive tennis ball.

2. A captive tennis ball apparatus for practice purposes as defined in claim 1, wherein said at least one relatively inelastic, high strength cord has tensile strength in the range of from about 3,100 to about 4,000 pounds per square inch and is incapable of being stretched repeatedly to more than about 350% of its original length without breaking or rupturing or without suffering permanent deformation or permanent set.

3. A captive ball apparatus for practice purposes as defined in claim 1, wherein said relatively elastic, lower strength cords have tensile strengths in the range of from about 2,000 to about 2,900 pounds per square inch and can be stretched repeatedly at least to about 400% of their original length without breaking or rupturing or without suffering permanent deformation or permanent set and, after removal of the stretching force, will immediately and forcibly return to approximately their original length.

4. A captive ball apparatus for practice purposes as defined in claim 1, wherein at least one additional reltively elastic, lower strength cord is attached to said captive ball, said additional relatively elastic, lower strength cord being adapted to be secured to an additional support.

5. A captive ball apparatus for practice purposes as defined in claim 1, wherein a plurality of additional relatively elastic, lower strength cords are attached to said captive ball, said plurality of additional relatively elastic, lower strength cords being adapted to be secured to a plurality of additional supports.

6. A captive tennis ball apparatus for practice purposes as defined in claim 1, wherein said suspending means comprises only one relatively inelastic, high strength cord.

7. A captive tennis ball apparatus for practice purposes as defined in claim 1, wherein said suspending means comprises two relatively inelastic, high strength cords.

8. A captive tennis ball apparatus for practice purposes as defined in claim 1, wherein a mounting patch is provided to attach said suspending means to the spherical surface of the captive tennis ball.

9. A captive tennis ball apparatus for practice purposes as defined in claim 1, wherein said suspending means so suspends said captive tennis ball as to provide an equal length of relatively inelastic, high strength cord on each side of said captive tennis ball.

* * * * *